US010233657B2

(12) United States Patent
Jacober et al.

(10) Patent No.: US 10,233,657 B2
(45) Date of Patent: Mar. 19, 2019

(54) JOINER

(71) Applicants: Philip John Jacober, Paso Robles, CA (US); David Harold Cecil, Ventura, CA (US)

(72) Inventors: Philip John Jacober, Paso Robles, CA (US); David Harold Cecil, Ventura, CA (US)

(73) Assignee: Tapper Tool Co., LLC, Paso Robles, CA (US)

( * ) Notice: Subject to any disclaimer, the term of this patent is extended or adjusted under 35 U.S.C. 154(b) by 543 days.

(21) Appl. No.: 15/081,374

(22) Filed: Mar. 25, 2016

(65) Prior Publication Data

US 2017/0275894 A1 Sep. 28, 2017

(51) Int. Cl.

| | |
|---|---|
| ***E04F 21/20*** | (2006.01) |
| ***B25D 17/02*** | (2006.01) |
| ***E04F 15/02*** | (2006.01) |

(52) U.S. Cl.

CPC ..... *E04F 21/20* (2013.01); *B25D 17/02* (2013.01); *E04F 15/02038* (2013.01); *B25D 2222/75* (2013.01)

(58) Field of Classification Search

CPC ..... E04F 21/20; E04F 21/22; E04F 15/02038; B25D 17/28

See application file for complete search history.

(56) References Cited

U.S. PATENT DOCUMENTS

| | | | | |
|---|---|---|---|---|
| 3,143,335 | A * | 8/1964 | Lassahn | B25B 5/061 254/11 |
| 4,332,203 | A * | 6/1982 | Flowers | E04F 21/22 105/422 |
| 7,913,976 | B2 * | 3/2011 | Gaunt | E04F 21/22 254/11 |
| 8,434,738 | B1 * | 5/2013 | Anstett | E04F 21/22 254/11 |
| 2013/0043052 | A1 | 2/2013 | Harcar et al. | |

FOREIGN PATENT DOCUMENTS

| | | | |
|---|---|---|---|
| EP | 0 790 372 | A1 | 9/1999 |

* cited by examiner

*Primary Examiner* — Daniel J Wiley

(74) *Attorney, Agent, or Firm* — Paul D. Chancellor; Ocean Law

(57) ABSTRACT

A joiner for assembling planks includes a link interconnecting a ram and a motorized tool.

12 Claims, 11 Drawing Sheets

JOINER

INCORPORATION BY REFERENCE

This application incorporates by reference, in its entirety and for all purposes, U.S. Pat. Pub. No. 20130043052 filed Jul. 23, 2012.

BACKGROUND OF THE INVENTION

Field of the Invention

The present invention relates to an article of manufacture for use in the construction industry. In particular, the present invention provides a system and method for joining building materials such as planks and plank flooring.

Description of the Related Art

In the building construction industry there is frequently a need to join adjacent planks For example, plank flooring such as tongue and groove plank flooring requires that the tongue of a first plank be joined with the groove of a second adjacent plank. Standard practice typically relies primarily on hammers and/or nailers to join adjacent planks. Importantly, gaps between adjacent planks are to be eliminated during installation to provide a smooth surface when the job is finished and for years thereafter.

Imperfections in dimensions including any of plank, tongue, and groove dimensions increase the difficulty of making gapless joints. For example, a tongue may be slightly oversized such that greater effort is required to mate the tongue in the groove.

Yet other challenges include joints that are glued. Here, there is a need to distribute the glue in a manner that allows the joint to close while coating areas of the mating joint surfaces sufficiently to permanently fix adjacent planks together.

Because a signal achievement in the installation of a planked surface is gapless and tight joints, installers spend a great deal of time making up the plank joints. Despite this, gaps between planks remain an all too common occurrence owing to one or both of plank to plank gaps that exist immediately after the planked surface is installed and/or similar gaps that appear over time.

SUMMARY OF THE INVENTION

A joiner includes a link interconnecting a ram and a motorized tool.

In an embodiment, a joiner is for assembling tongue and groove planks, the joiner comprising: a link interconnecting a ram and a motorized hammer; the link including a tang and a shank; a free end of the shank fixed in jaws of the motorized hammer; a rounded end of the tang with a center hole, the rounded end seated in a rounded V slot of the ram; the tang rotatably fixed in the slot by a clevis pin passing through the slot and through the hole in the tang; the ram including a block, a handle centrally located atop the block, and plural thumb screws; the block having an upper portion and a lower portion, the upper portion overhanging the lower portion so as to create a void along a first edge of the block for receiving a tongue of a tongue and groove plank; and, the thumb screws passing through respective corners of the block for supporting the block at adjustable elevations.

In some embodiments, a shank includes one bend and a tang central axis intersects with a shank central axis at an angle of 20 to 45 degrees.

In some embodiments, the link includes two bends and a tang central axis is parallel to the central axis of the shank portion extending from the jaws of the motorized hammer.

In some embodiments, the link includes first and second shank portions interengaged via a coupling that transmits hammer blows but that does not transmit rotation. In some embodiments, a rotary hammer and such a link may be used with other than a ram, for example with a chisel or similar tool operable with a motorized hammer.

In some embodiments, the joiner includes: a sled; a top side of the sled for engaging portions of thumb screws that pass through the block; a bottom side of the sled for resting upon and smoothly passing over a plank underlayment; and, the sled and screw engagements for allowing rotation of the screws without rotating the sled.

In an embodiment, a hammering method, the method comprising the steps of: providing a rotary hammer with a variable speed control; providing a link fixed in the chuck of the rotary hammer; and preventing accidental rotation of a tool integral with or attached to the link via inclusion of a rotary coupling between first and second portions of the link.

In some embodiments, the hammering method further comprises the steps of: rotatably affixing a ram to the link, the axis of rotation being about perpendicular to a ram top surface; positioning the ram on a subfloor adjacent to a first plank; adjusting ram thumb screws at ram corners such that a ram tongue and groove edge is aligned to interengage with a first plank tongue and groove edge; pressing the ram tongue and groove edge into the first plank tongue and groove edge; holding the ram via a ram handle; and, operating the rotary hammer at variable speeds to close a gap between the first and second planks.

BRIEF DESCRIPTION OF THE DRAWINGS

The present invention is described with reference to the accompanying figures. These figures, incorporated herein and forming part of the specification, illustrate embodiments of the present invention and, together with the description provide examples enabling a person skilled in the relevant art to make and use the invention.

DESCRIPTION OF PREFERRED EMBODIMENTS

The disclosure provided herein describes examples of some embodiments of the invention. The designs, figures, and descriptions are non-limiting examples of the embodiments they disclose. For example, other embodiments of the disclosed device and/or method may or may not include all of the features described herein. Moreover, disclosed advantages and benefits may apply to only certain embodiments of the invention and should not be used to limit the disclosed invention.

Figure 1:
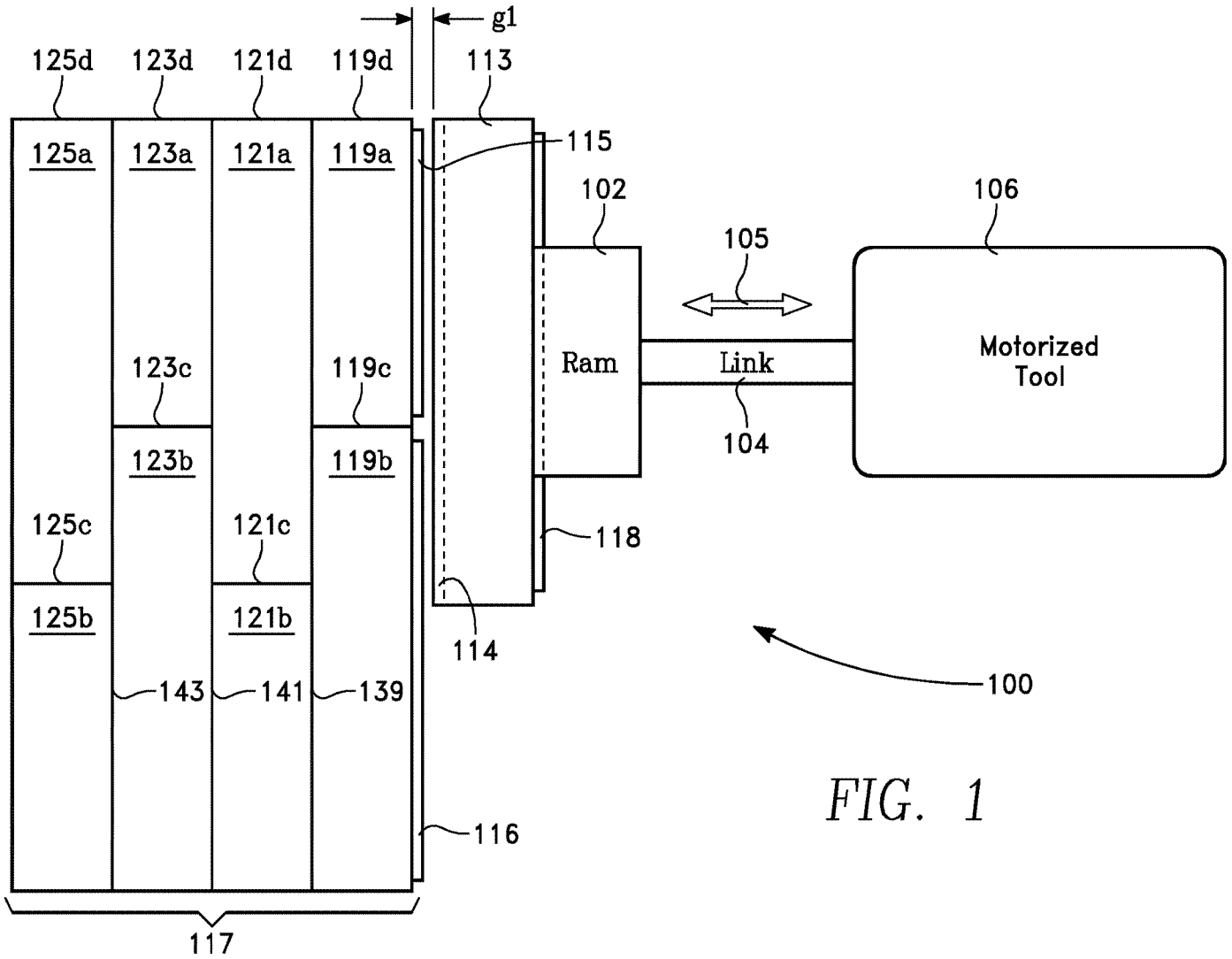
FIG. 1 shows an example of the joiner of the present invention.

FIG. 1 shows an embodiment of the present invention 100. In the figure, a plank flooring installation process is underway. An installed section of flooring 117 includes plank lines 119*d*, 121*d*, 123*d*, 125*d*. In each plank line, a plurality of planks butt end to end 119*a-b*, 121*a-b*, 123*a-b* and 125*a-b* at joints 119*c*, 121*c*, 123*c*, and 125*c*. Plank lines are joined along their lengths 139, 141, 143.

As seen, the current step in the process is the joining of an extension plank 113 to the section of flooring already installed 117. In this joining process, tongues 115, 116 of the installed planks 119*a*, 119*b* will be inserted in a groove 114 of the extension plank 113. An object of the installation is to eliminate the gap g1 located between adjacent planks.

This installation process may be aided by using a motorized tool such as a motorized hammer to hammer 105 the extension plank into gapless engagement with the base planks 119*a-b*. However, as skilled artisans will appreciate, suitable means for generating and transmitting hammer forces to the extension plank varies from job to job and failure to adapt to the materials and configuration of a particular job can be disastrous as when hammer forces are too large, bearing areas are too small, and/or bearing areas are too weak.

As shown, a motorized tool 106 such as a motorized impact tool with an internal controller for operating at variable speed and/or power and/or force and/or throw such as a variable speed rotary hammer. The motorized impact tool transmits hammer blows via a link 104 to a ram 102. The ram in turn transmits the hammer blows to the extension plank 113 which forces the extension plank groove 114 to engage and/or seat in the base plank tongues 115, 116. In some embodiments the motorized tool is a rotary hammer with a hammer only mode of operation.

Figure 2:
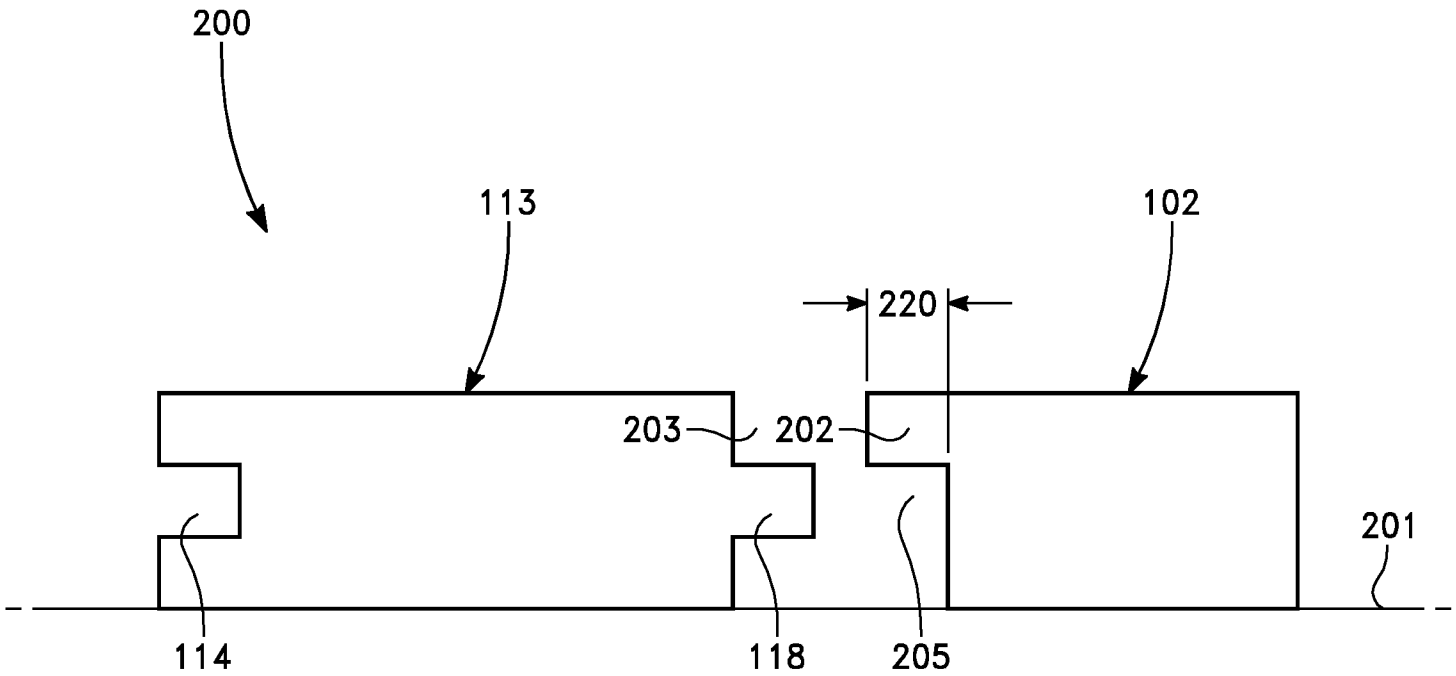
FIG. 2 shows planks for use with the joiner of FIG. 1.

FIG. 2 shows an exemplary plank and ram interface 200. Atop a subfloor 201, the ram 102 is positioned alongside the extension plank 113. To one side of the plank is a groove 114 and opposite the groove is a tongue 118.

When the ram 102 is mated with the extension plank 113, a ram lip 202 passes over the tongue 118 and fills a void space 203 above the tongue. At the same time, the tongue 118 passes below the lip and fills a void space 205 below the lip. Abutments of lip and plank and/or tongue and ram provide surfaces for transferring hammer forces. The lip projection 220 may be adjusted to select one or both of these bearing surfaces.

Figure 3A:
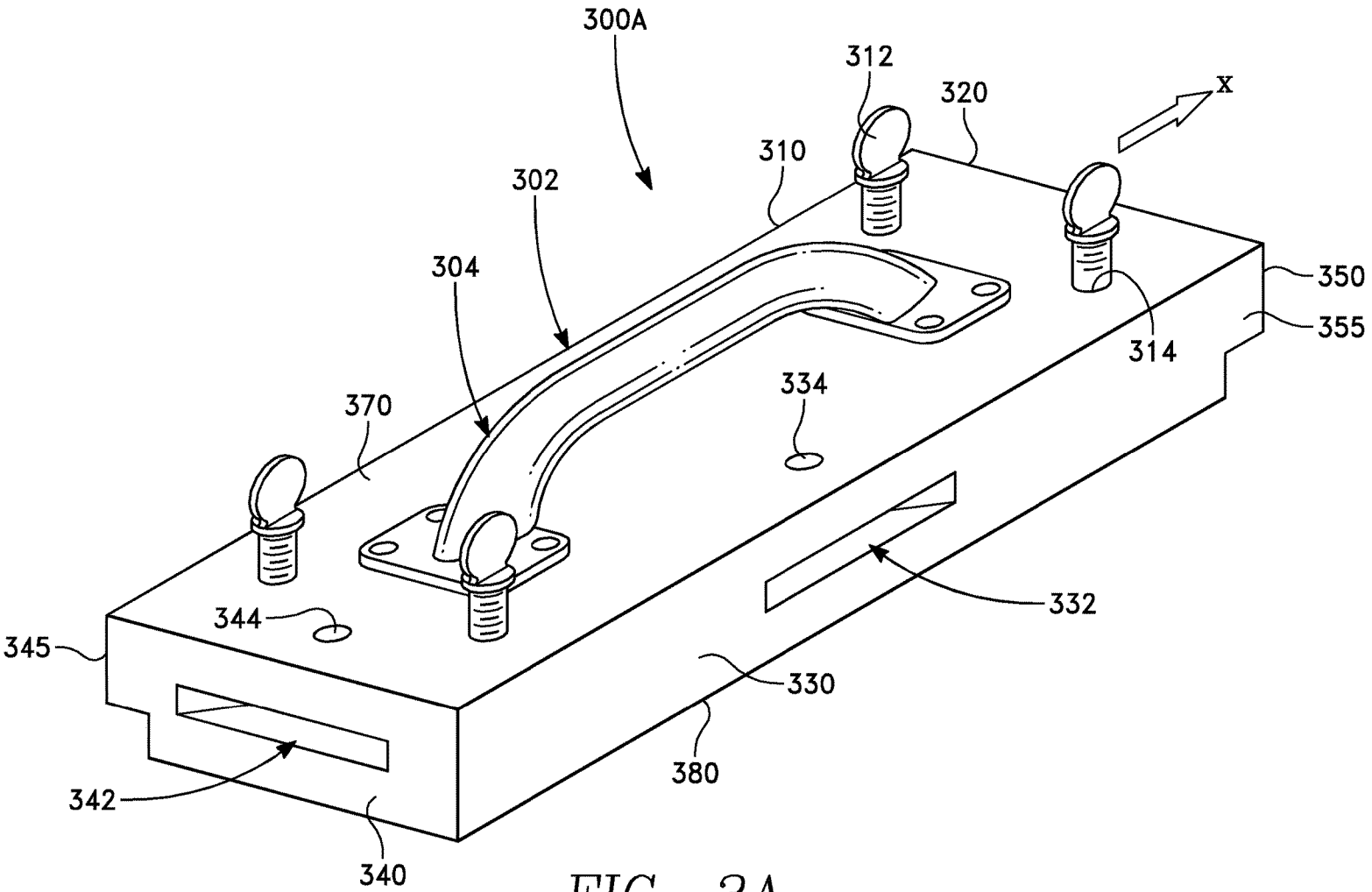
FIG. 3A shows a perspective view of a ram of the joiner of FIG. 1.

FIG. 3A shows an exemplary ram 300A. The ram includes a ram block 302 having a block top 370 and a block bottom 380. The ram may include one or more a longitudinal handle atop the block 304 and leveling devices such as four corner screws 312 penetrating the block 302 via block holes 314.

Block 302 materials of construction may include one or more of steel such as mild steel, wood such as hardwood, plastic, and composites such as glass, fiberglass and/or carbon, carbon fiber composites. In an embodiment, the block is made from a material or plastic with a hardness of 90 to 120 on the Rockwell R scale. In an embodiment the block is made from a polypropylene with a hardness of 90 to 120 on the Rockwell R scale.

Block 302 materials of construction suited for damping bounce during operation may include one or more viscoelastic materials for damping, for example along an edge of the block that mates with a plank. These materials include polymers (particularly thermoplastics), HDPE, rubber, polytetraftuoroethylene (PTFE), polyurethane, a polypropylene/butyl rubber blend, a polyvinylchloride/chlorinated polyethylene/epoxidized natural rubber blend, a polyimide/polyimide blend, a polysulfone/polysulfone blend, a nylon-6/polypropylene blend, and a urethane/acrylate interpenetrating polymer network.

Handle 304 materials of construction include one or more of wood, plastic, and metal. In an embodiment the handle is integral with the base. Handle materials other than base materials include cast parts such as zinc die cast parts.

Corner screw 312 materials of construction include wood, plastic, and metal. In an embodiment, the corner screws are 14-20 threaded steel thumb screws.

Figure 3B:
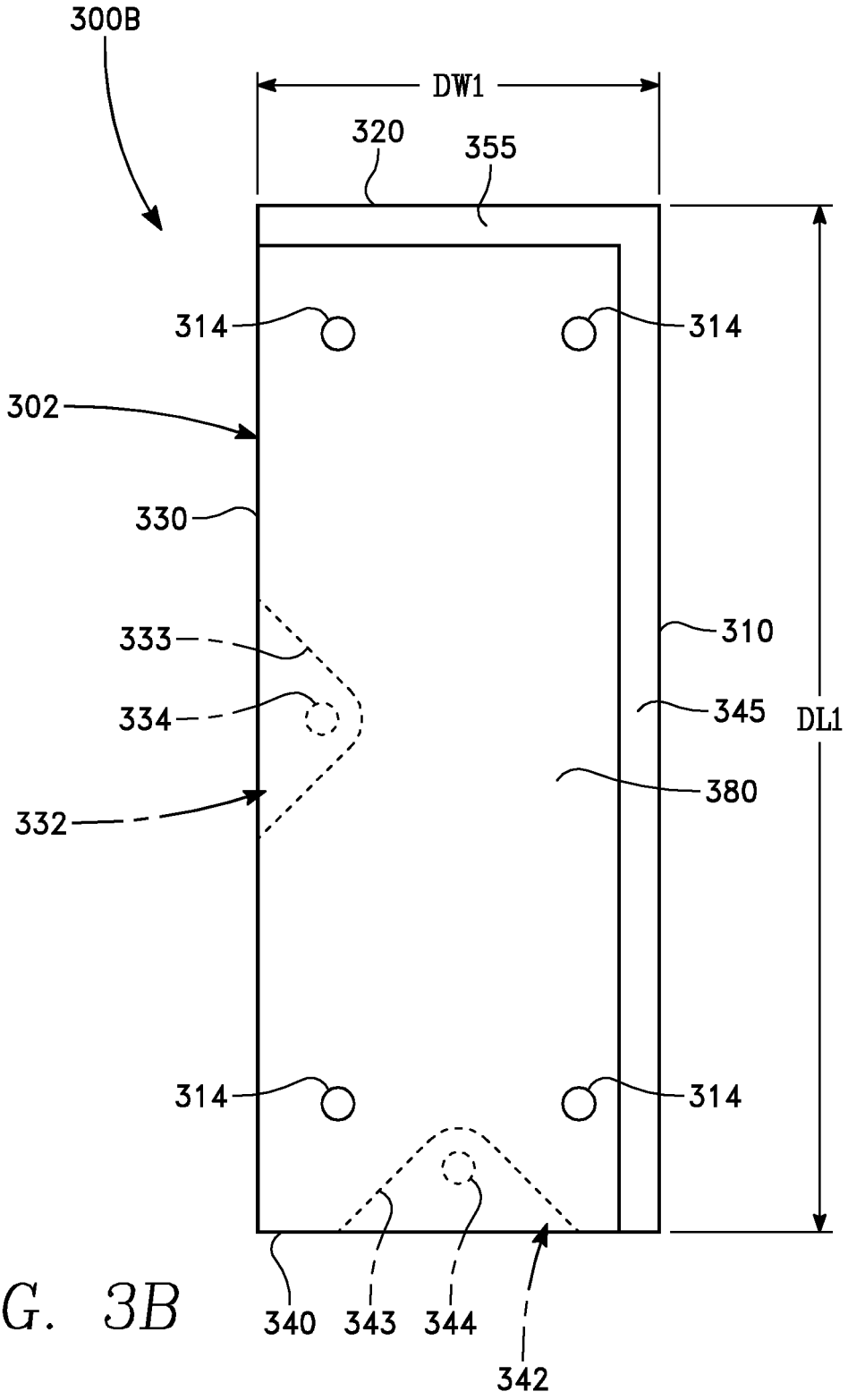
FIG. 3B shows a bottom view of the ram of FIG. 3A.

FIG. 3B shows a bottom view 300B of the block of FIG. 3A. As seen, four leveling screw holes 314 penetrate the block. As seen in FIGS. 3A-B, a block 302 boundary includes opposed longitudinal sidewalls 310, 330 and opposed transverse sidewalls 340, 350. A longitudinal sidewall 330 includes a centrally located slot 332 and a transverse sidewall 340 may include a centrally located slot 342. The slot may have a square, rectangular, or curved cross-section. As shown, each slot 332, 342 has a cross section 333, 343 with a curved bottom, for receiving a similarly curved link tang, and somewhat straight sides. This slot cross section may be referred to as a "round bottom V" shape.

Clevis hole 334 is for receiving a pin that passes through the slot 332 to rotatably fix a tang such as a link or link end (see below) to the block. Clevis hole 344 is for receiving a pin that passes through slot 342 to rotatably fix a tang such as a link or link end (see below) to the block.

Similar to the lip 202 shown in FIG. 2, the ram of FIGS. 3A-B includes a lip. In particular, the block 302 shown includes both a longitudinal lip 345 and a transverse lip 355 such that the block may interface with a plank tongue along a short or transverse dimension "DW1" or along a long or longitudinal dimension "DL1". In an embodiment, the ratio of DL1 to DW1 is in the range of 2 to 3. In an embodiment, the ratio of DL1 to DW1 is about 2.6. In an embodiment, DL1 is in the range of 7.5 to 9.5 inches. In an embodiment, DW1 is in the range of 2.25 to 4.25 inches. In an embodiment, DL1 is 8.5 inches. In an embodiment DW1 is 3.5 inches.

Figure 4A:
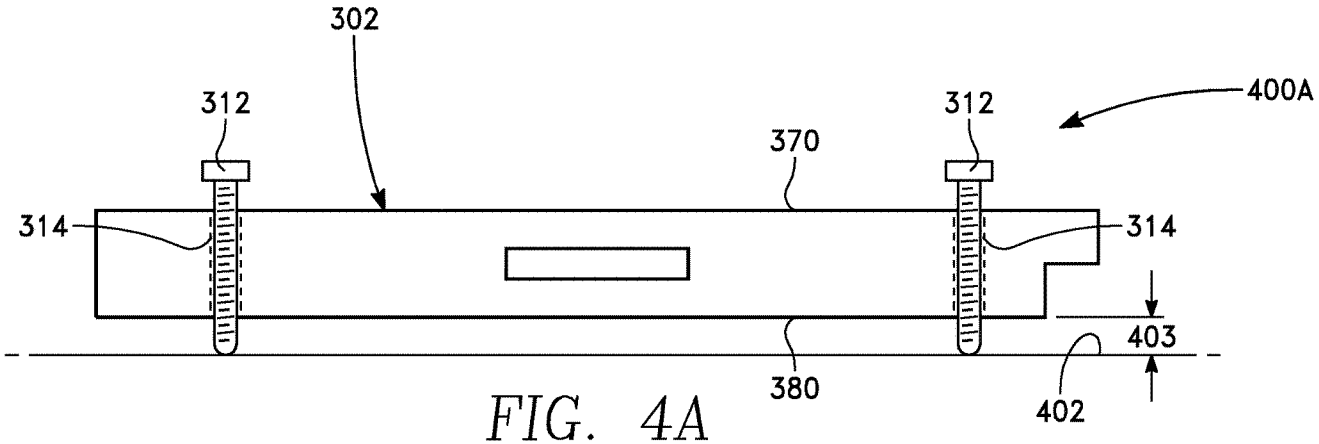
FIG. 4A shows a side view of the ram with elevation screws of FIG. 3A.

FIG. 4A shows a block elevation feature 400A. As shown in FIG. 3A above, four thumb screws 312 are located in block through holes 314 at block corners. These screws may be used for adjusting a distance 403 between the block and a block supporting surface 402 such as a subfloor. This feature is useful for, among other things, positioning a block to engage desired portions of a plank or plank edge such for properly engaging a plank tongue 115, 116. These screws may also be used for leveling the block.

In an embodiment, a length of the block DL1 is selected such that for the hammer used, the pressure exerted by the block on the plank does not exceed one of twenty-five or fifty or seventy-five percent of the plank compressive strength at the block and plank interface. In an embodiment, a length of the block DW1 is selected such that for the hammer used, the pressure exerted by the block on the plank does not exceed fifty percent of the plank compressive strength at the block and plank interface.

Figure 4B:
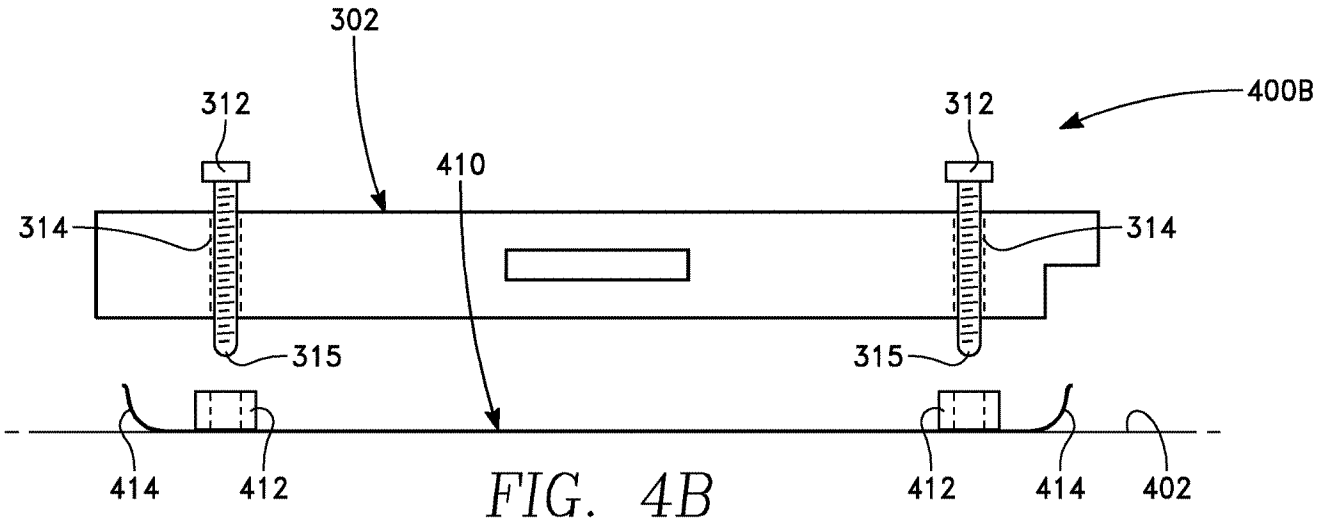
FIG. 4B shows a sled for use with the ram of FIG. 3A.

FIG. 4B shows a block and a block sled 400B. As shown, the block 302 is for engaging a sled 410 via the block thumb screws 312 which seat in mating sled bosses 412. The sled may have curved up ends 414 as shown and/or curved up sides.

Among other things, the block sled 410 provides for smooth block motion over the supporting surface 402 by isolating thumb screw 312 ends 315 from the supporting surface. For example, where planks being joined make up a floating floor a foam pad may separate the planks from a subfloor. Because such a foam pad is easily damaged, the sled may be needed to guard against foam pad damage.

FIGS. 5A-D show links 500A-D. The links may include a tang and a shank. Overall length of the links may vary in a first range of about 4 to 14 inches. Overall length of the links may vary in a second range of about 6 to 14 inches. The ratio of tang to shank length may vary in a range of 1:1 to 1:4, for example equal lengths or a shank length that is four times tang length. Shank diameters may vary in a range of 0.25 to 0.75 inches and tang thicknesses may vary in a range of 0.125 to 0.5 inches.

Figure 5A:
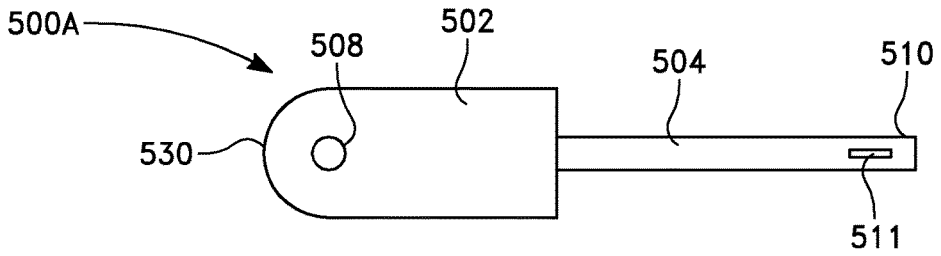
FIGS. 5A-D show links for use with the joiner of FIG. 1.

FIG. 5A shows a link 500A. The link includes a tang 502 and a shank 504. As shown, a tang free end 530 is curved for mating with a slot 332, 342 of the block 302. A hole in the tang 508 is for receiving a clevis pin, for example the clevis pin 638 of FIG. 6C. Skilled artisans will appreciate clevis pin functions including rotary fixation of the link to the block despite action of an attached motorized tool 106 tending to withdraw the tang from the slot.

A feature 511 near the shaft free end 510 is for mating with a motorized tool, for example a hammer tool 106. For example, the link may mate with a mechanical connector of a motorized tool. For example, the link may mate with an SDS type chuck. For example, the link may mate with an SDS-Plus type chuck.

Figure 5B:
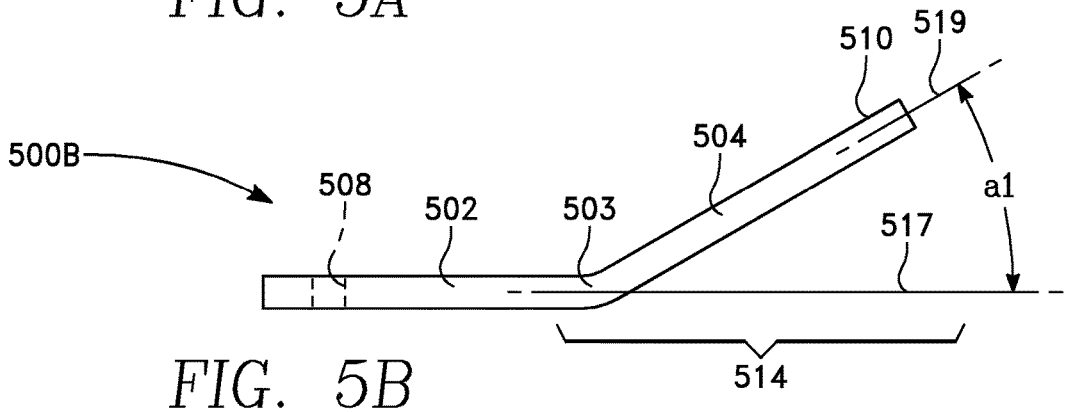

FIG. 5B shows a single angle link 500B. The link includes a tank 502 and a shank 514 with a bend 503 therebetween. As shown, the link has bend in a plane about perpendicular to the plane of the tang 502. The bend is located at or near the meeting point of the tang 502 and the shank 504. This bend may provide space for operation of the motorized tool 106 where proximity of a supporting surface 402 would otherwise make this difficult.

In an embodiment, a central axis 517 of the tang 502 is displaced from a central axis 519 of the shank 519 by an angle a1. In an embodiment, a1 is in the range of 0 to 22 degrees. In an embodiment, a1 is in the range of 0 to 30 degrees. In an embodiment, a1 is in the range of 0 to 40 degrees.

Figure 5C:
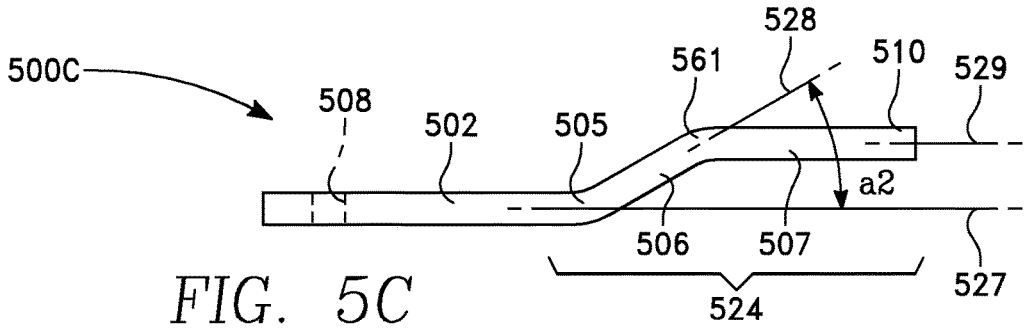

FIG. 5C shows a dual angle link 500C. The link includes a tang 502 and a shank 524. As shown, the link has two bends 505, 561. A first bend 505 is in a plane about perpendicular to the plane of the tang 502 and located near a meeting point of the tang 502 and a first shank portion 506 having a central axis 528. A second bend 561 is in a plane about perpendicular to the plane of the tang 502 and located near a meeting point of the first shank portion 506 and a second shank portion 507 having a central axis 529. In some embodiments, the dual angle link provides a second shank portion 507 that is about parallel to the tang 502. These bends may provide space for operation of the motorized tool 106 where proximity of a supporting surface 402 would otherwise make this difficult.

Some links may include a rotatable coupling such as a slip joint, a ball and socket, a disc and socket, a pin and socket, a rotary cage, and the like. In an embodiment a rotary coupling may comprise a first shank portion with a socket for receiving a second shank portion with a pin wherein the pin includes an external grove and a circlip or snap ring in the groove is for seating within a socket internal grove. In some embodiments force is transferred through the link when a pin end impacts a socket bottom. Suitable rotatable couplings may aid a user in positioning the ram 102 and in handling the ram-link-motorized tool 102-104-106 assembly. Such rotatable couplings may provide a safety feature where the motorized tool is a rotary hammer and when accidental actuation of rotary operation would otherwise rotate the ram.

Figure 5D:
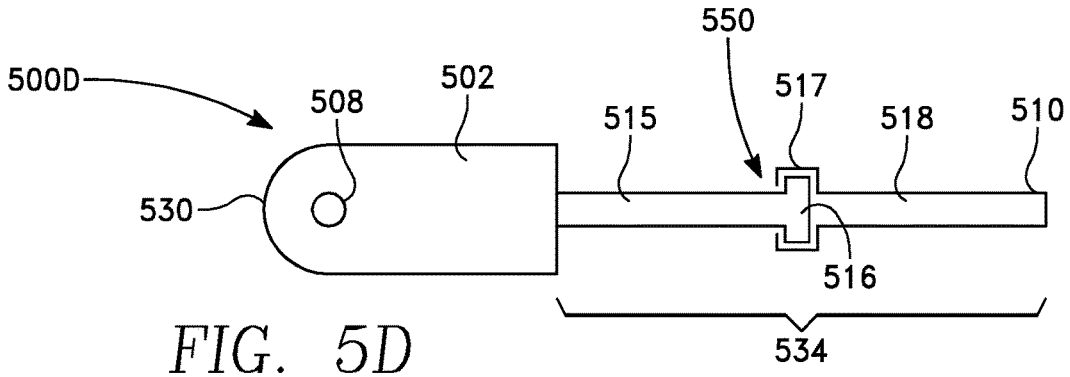

FIG. 5D shows a link with a rotatable coupling 500D. The link includes a tang 502 and a shank 534. The shank includes first and second parts 515, 518 that mate at a central coupling 550. The purpose of the coupling is to prevent a rotation of the second shank part 518 from being transmitted to the first shank part 515 while continuing to transmit motorized tool forces such as hammer blows via the link. A number of different couplings might be used including ball-socket and rotor-stator type couplings. In the figure, a rotor-stator type coupling is illustrated where a rotor 516 terminates the first shank part 515 and a stator 517 that encloses the rotor terminates the second shank part 518.

In an embodiment, a central axis 527 of the tang 502 is displaced from a central axis 528 of the shank portion 506 by an angle a2. In an embodiment, a2 is in the range of 0 to 22 degrees. In an embodiment, a2 is in the range of 0 to 30 degrees. In an embodiment, a2 is in the range of 0 to 40 degrees. In an embodiment, a tang central axis 527 is parallel to the central axis of a shank portion extending from jaws of a motorized hammer 507.

Links 500A-D may be made from materials including a metal such as steel. The steel chosen is a material suited for the block 302 material and the motorized tool 106 interface. In an embodiment, the link is made from a mild steel. In an embodiment, the link is made from a hardened steel.

As skilled artisans will appreciate, the features of FIGS. 5A-D may be used alone or in combination. For example, the coupling 550 of FIG. 5D might be used in any of FIGS. 5A-C. Where a coupling is used in the embodiments of FIGS. 5B-C, it would be located in a shank portion nearest the motorized tool.

Figure 6A:
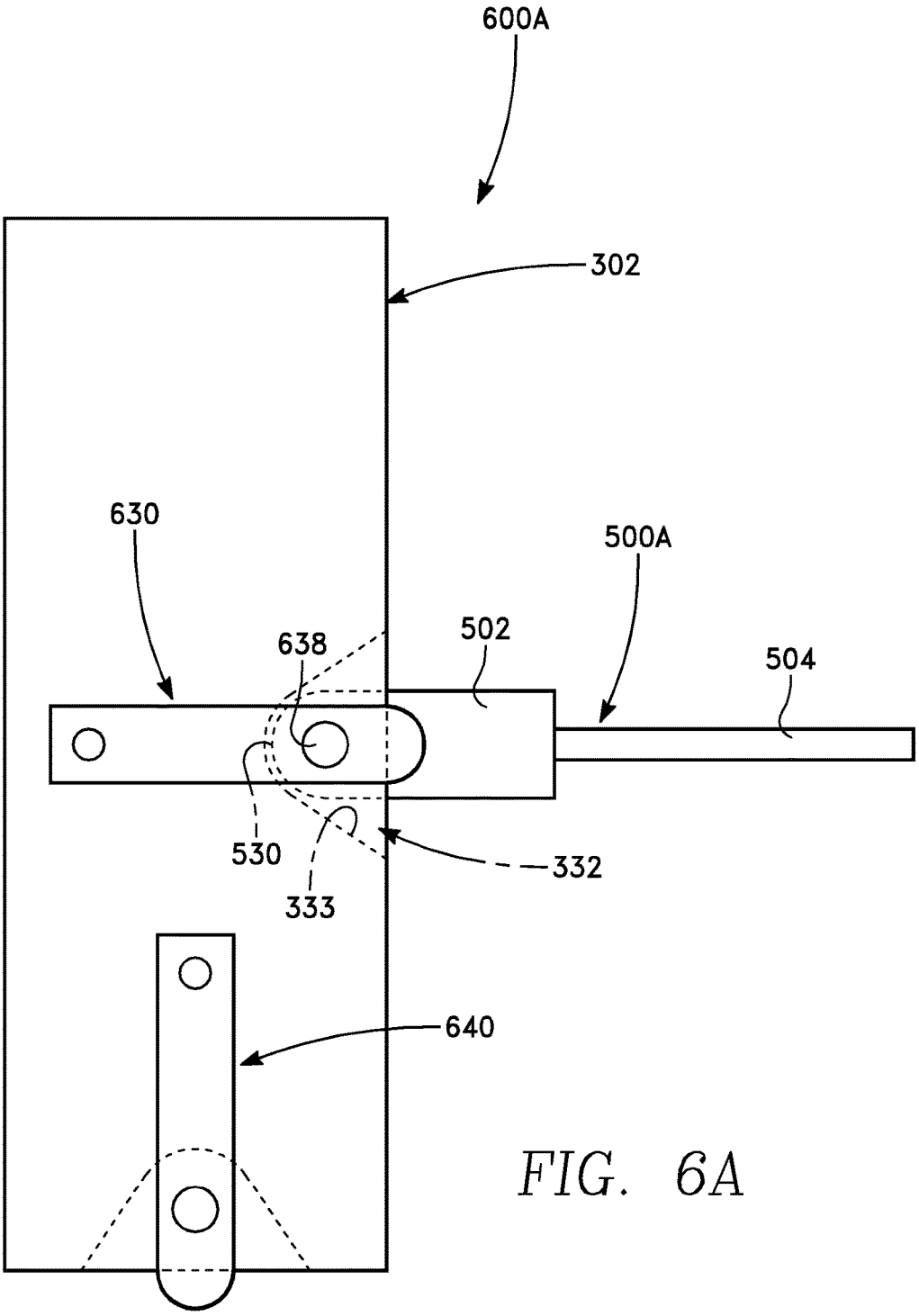
FIGS. 6A-B show articulation of the link and ram of FIG. 1.
Figure 6B:
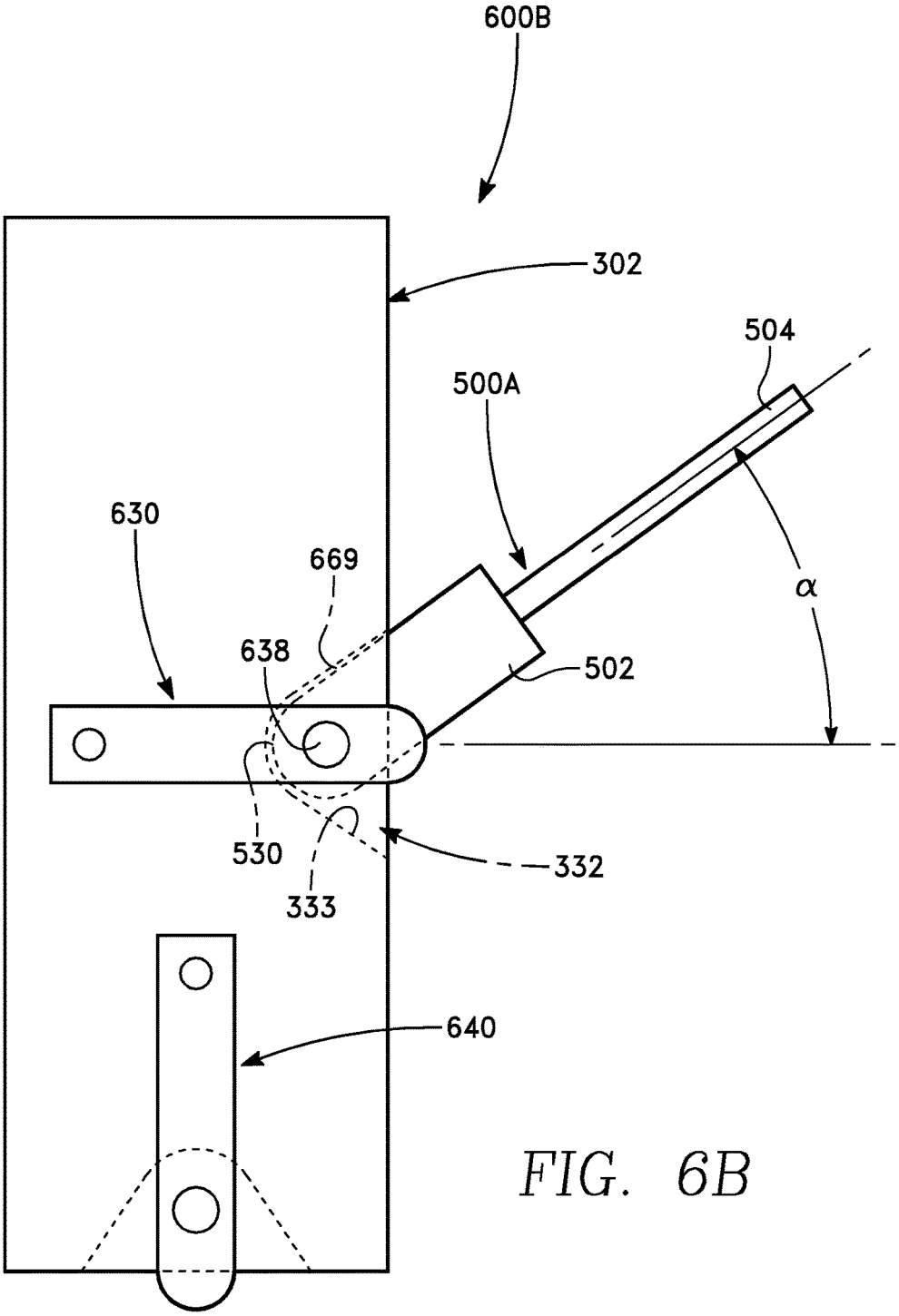

FIGS. 6A-B show an assembled block and link 600A-B.

In FIG. 6A, the link 500A is about perpendicular to the longitudinal axis of the block 302 with the link inserted in a slot 332 of the block. This alignment may be referred to as a "straight on" alignment or an $\alpha=0$ alignment where alpha is an angle measured between a transverse axis of the block and a longitudinal axes of the link. As skilled artisans will appreciate, any of the links described above might be used.

The link 500A is rotatably fixed to the block 302 via a clevis pin 638 and the link is rotatable about the clevis pin. This rotatable link feature provides for maneuverability of the block relative to a motorized tool 106 used to drive the link and it damps unwanted vibration of the block 302 during operation.

In FIG. 6B, the link 500A to block 302 alignment is not straight-on, but canted to one side such that the tang 502 strikes a sidewall 669 of the slot 332 which blocks further rotation of the link relative to the block. As seen, the angle $\alpha$ is no longer zero. In an embodiment, $\alpha$ is in the range of 0 to 22 degrees. In an embodiment, $\alpha$ is in the range of 0 to 30 degrees. In an embodiment, $\alpha$ is in the range of 0 to 40 degrees.

Clevis pin 638 materials include metals. In an embodiment, clevis pin materials include stainless steel.

Figure 6C:
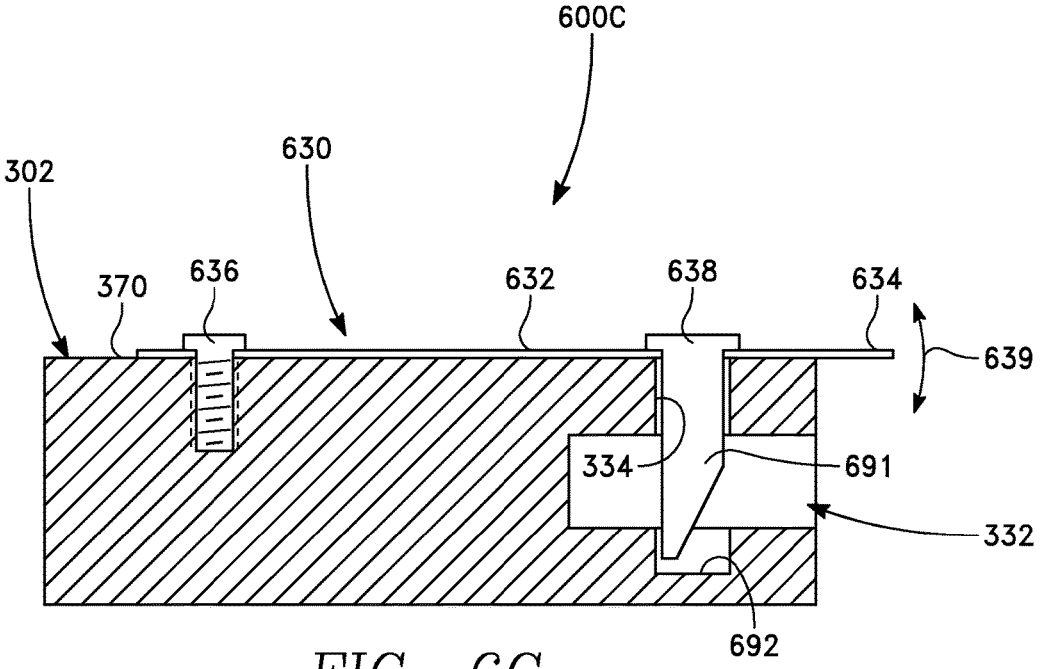
FIG. 6C shows a clevis pin engagement mechanism for use with ram of FIG. 3A.

FIG. 6C shows a clevis pin engagement mechanism 600C. Here, a spring strip 632 of the clevis pin engagement mechanism 630 lies atop 370 the block 202 and is fixed at one end by a fastener 636 anchored in the block. The spring strip engages a clevis pin 638 and tends to force the clevis pin shank 691 toward a bottom of the clevis pin hole 692. A spring free end 634 that overhangs the block is for grasping 639 to lift the clevis pin shank free of a link tang 502 (not shown for clarity) inserted in the slot 332. A second clevis pin engagement mechanism 640 operates in a similar fashion. In some embodiments the clevis pin may have a chamfered end so that insertion of the tang raises the pin and allows the tang to slide into the slot below the pin.

Spring strip 634 materials of construction include one or more of plastic and metal. In an embodiment, spring strip materials include spring steel. In an embodiment, spring strip materials include a resilient plastic. In an embodiment, spring strip materials include a composite such as fiberglass.

Figure 7A:
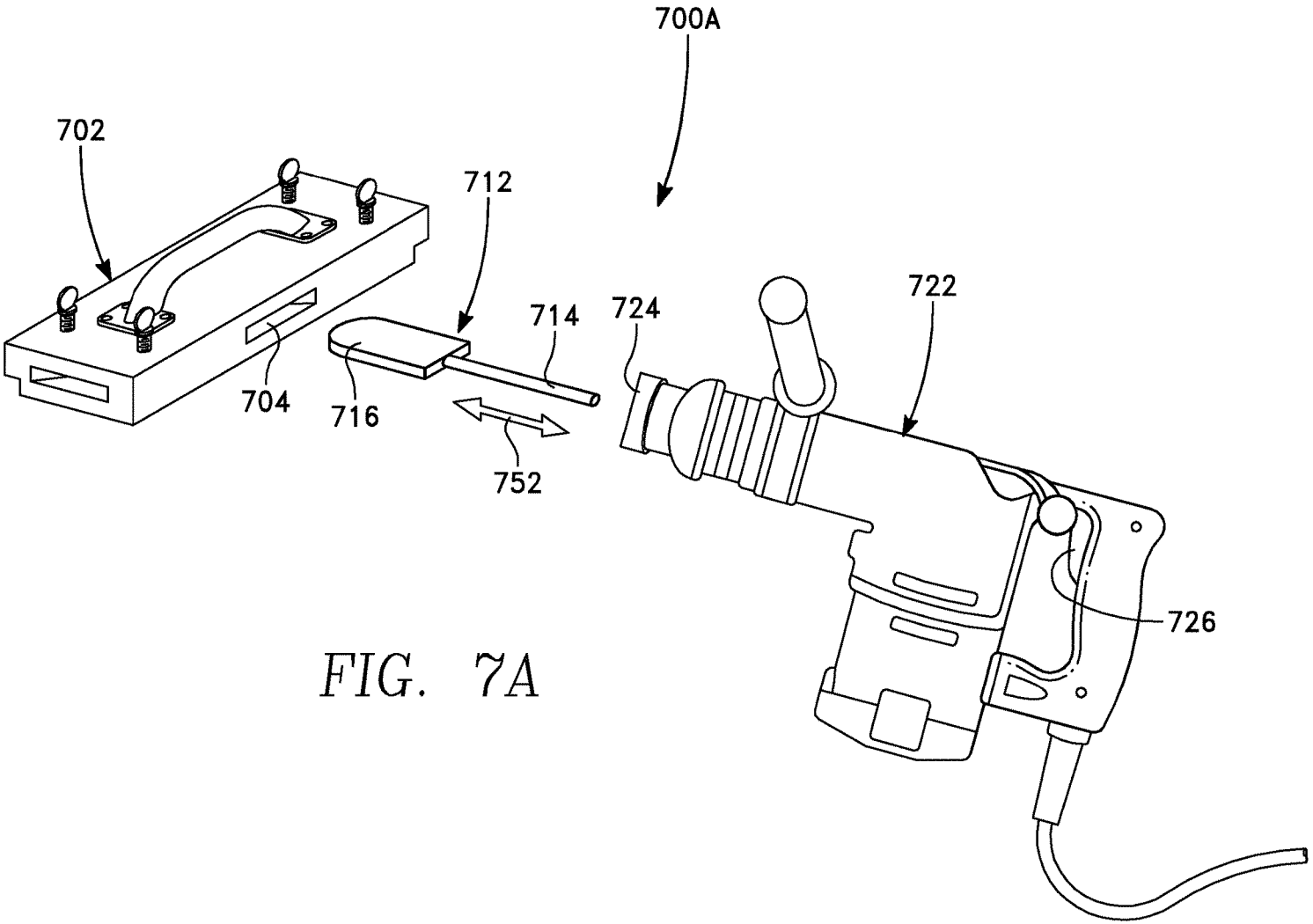
FIGS. 7A-B show exemplary configurations of the joiner of FIG. 1.
Figure 7B:
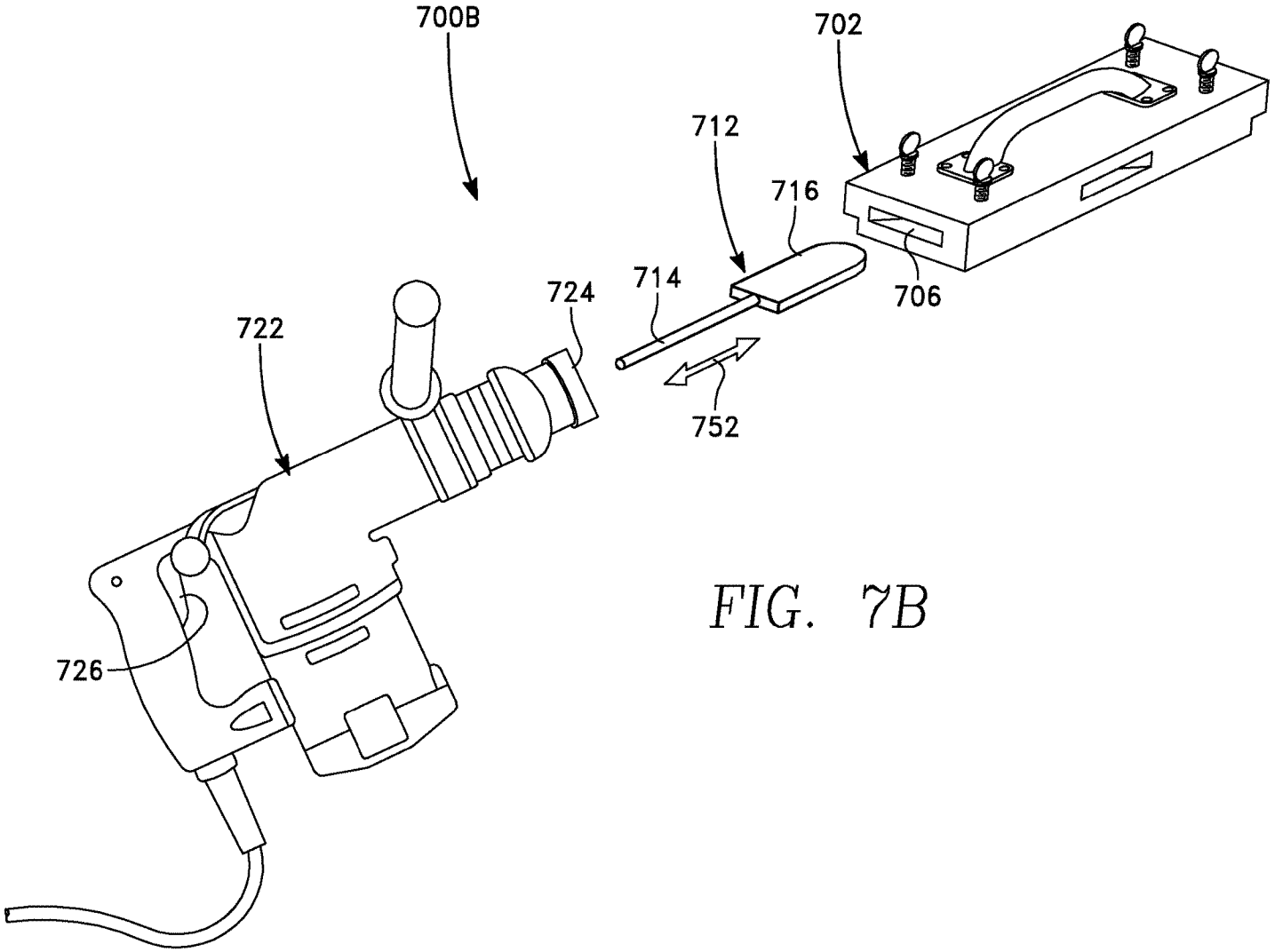

FIGS. 7A-B show an assembly of joiner parts 700A-B.

In FIG. 7A, a ram 702 includes a side slot 704. A link 712 has a tang 716 for insertion in the slot. A shank of the link 714 is inserted in a chuck or jaws 724 of a motorized tool 722. When operated, the motorized tool imparts a hammer-like motion 752 to the ram via the link. The motorized tool may provide variable speed and/or variable hammer force and/or stroke operation as by use of a trigger control 726. In an embodiment, a motorized tool such as a Makita® 18V LXT seven eights inch rotary hammer model XRH03Z is used where the same is suitable for the application and the materials being installed. In some embodiments, the link includes a coupling similar to the coupling 550 of FIG. 5D to prevent rotation of the tang should the motorized tool jaw rotate.

In FIG. 7B, a ram 702 includes an end slot 706. A link 712 has a tang 716 for insertion in the slot. A shank of the link 714 is inserted in jaws 724 of a motorized tool 722. When operated, the motorized tool imparts a hammer-like motion 752 to the ram via the link. The motorized tool may provide variable speed and/or variable hammer force and/or stroke operation as by use of a trigger control 726. In an embodiment, a motorized tool such as a Makita® 18V LXT seven eights inch rotary hammer model XRH03Z is used where the same is suitable for the application and the materials being installed. In some embodiments, the link includes a coupling similar to the coupling 550 of FIG. 5D to prevent rotation of the tang should the motorized tool jaw rotate.

Examples of use include FIGS. 1, 7A, and 7B. In an exemplary operation, the joiner is assembled as shown in FIG. 7A and put to use as shown in FIG. 1. During use a user grasps the block handle 304, positions the block alongside an extension plank 113 and adjusts the thumb screws 312 to achieve the desired mating between the block 302 and the extension plank and/or a tongue(s) 115, 116 of the extension plank. The user locates the extension plank alongside a base plank(s) 119*a-b*, and operates the interconnected motorized tool 106 using one or more desired hammer impact forces to create a gapless joint between the base and extension planks In some embodiments the sled of FIG. 4B is used as shown.

While various embodiments of the present invention have been described above, it should be understood that they have been presented by way of example only, and not limitation. It will be apparent to those skilled in the art that various changes in the form and details can be made without departing from the spirit and scope of the invention. As such, the breadth and scope of the present invention should not be limited by the above-described exemplary embodiments, but should be defined only in accordance with the following claims and equivalents thereof.

What is claimed is:

1. A joiner for assembling tongue and groove planks, the joiner comprising:

a link interconnecting a ram and a motorized hammer;

the link including a tang and a shank;

a free end of the shank fixed in a chuck of the motorized hammer;

a rounded end of the tang with a center hole, the rounded end seated in a rounded V slot of the ram;

the tang rotatably fixed in the slot by a clevis pin passing through the slot and through the center hole in the tang;

the ram including a block, a handle centrally located atop the block, and plural thumb screws;

the block having an upper portion and a lower portion, the upper portion overhanging the lower portion so as to create a void along a first edge of the block for receiving a tongue of a tongue and groove plank; and, the thumb screws for passing through respective corners of the block for supporting the block at adjustable elevations.

2. The joiner of claim 1 wherein a shank includes one bend and a tang central axis intersects with a shank portion central axis at an angle of about 20 to 45 degrees.

3. The joiner of claim 1 wherein the link includes two bend and a tang central axis is parallel to the central axis of the shank portion extending from the chuck of the motorized hammer.

4. The joiner of claim 1 wherein the motorized tool is a rotary hammer and the link includes first and second shank portions interengaged via a coupling that transmits hammer blows but that does not transmit rotation.

5. The joiner claim 1 further including:

a sled;

a top side of the sled for engaging portions of thumb screws the through the block;

a bottom side of the sled for resting upon and smoothly passing over a plank underlayment ;and, the sled and screw engagements for allowing rotation of the screws without rotating the sled.

6. A joiner for assembling tongue and groove planks, the joiner comprising:

a link interconnecting a ram and a motorized rotary hammer;

the link including:

a tang and a shank;

first and second shank portions interengaged via a rotary coupling for preventing transmission of rotary motion from the motorized rotary hammer to the ram;

a free end of the shank for fixation in the chuck of the motorized rotary hammer;

a rounded end of the tang with a center hole, the rounded end seated in a rounded V slot of the ram;

the tang for rotatable fixation in the slot by a clevis pin passing through the slot and through the hole in the tang;

a ram including:

a block, a handle centrally located atop the block, and thumb screws at corners of the block;

the block having an upper portion and a lower portion, the upper portion overhanging the lower portion so as to create a void along a first edge of the block for receiving a tongue of a tongue and groove plank; and, the thumb screws for passing through respective corners of the block for supporting the block at adjustable elevations.

7. The joiner of claim 6 further comprising:

a variable power control within the motorized rotary hammer for selectively controlling energy delivered by the hammer.

8. The joiner of claim 7 wherein: the pressure exerted by the block on a plank does not exceed fifty percent of the plank compressive strength at the block and plank interface.

9. A method of joining first and second tongue and groove planks, the method comprising the steps of:

providing the joiner of claim 1;

pressing the ram against the first tongue and groove plank; and operating the motorized hammer to close a gap between the first and second tongue and groove planks.

10. The method of claim 9 further comprising the steps of:

rotatably affixing a ram to the link;

positioning the ram on a subfloor adjacent to a first plank;

adjusting ram thumb screws at ram corners such that a ram tongue and groove edge is aligned to interengage with a first plank tongue and groove edge;

pressing the ram tongue and groove edge into the first plank tongue and groove edge;

holding the ram via the ram handle; and, operating the rotary hammer at variable speeds to close a gap between the first and second tongue and groove planks.

11. The method of claim 10 further comprising the step of: damping bounce imparted to the rotary hammer during operation by constructing a portion of the ram from a viscoelastic material.

12. The method of claim 10 further comprising the step of: damping bounce imparted to the rotary hammer during operation by constructing a tongue and groove edge of the ram from a viscoelastic material.

* * * * *